United States Patent [19]

Mochizuki et al.

[11] Patent Number: 4,833,500

[45] Date of Patent: May 23, 1989

[54] DEVELOPING APPARATUS

[75] Inventors: Manabu Mochizuki, Yokohama; Tuneo Kurotori, Tokyo, both of Japan

[73] Assignee: Ricoh Company, Ltd., Tokyo, Japan

[21] Appl. No.: 99,715

[22] Filed: Sep. 22, 1987

Related U.S. Application Data

[63] Continuation of Ser. No. 744,690, Jun. 14, 1985.

[30] Foreign Application Priority Data

Jun. 14, 1984 [JP] Japan ..... 59-122586
Jun. 14, 1984 [JP] Japan ..... 59-122587

[51] Int. Cl.[4] ..... G03G 15/06

[52] U.S. Cl. ..... 355/256; 118/651; 355/259

[58] Field of Search ..... 355/14 D, 3 DD, 10; 118/651, 647, 661

[56] References Cited

U.S. PATENT DOCUMENTS 4,003,650 1/1977 Courtney et al. ..... 355/14 D
4,194,828 3/1980 Hölz et al. ..... 355/14 D
4,277,549 7/1981 Tatsumi et al. ..... 355/14 D
4,306,804 12/1981 Sakamoto et al. ..... 355/14 D
4,326,795 4/1982 Tajima et al. ..... 355/14 D
4,395,112 7/1983 Miyakawa et al. ..... 355/14 D

*Primary Examiner*—R. L. Moses
*Attorney, Agent, or Firm*—Oblon, Fisher, Spivak, McClelland & Maier

[57] ABSTRACT

A developing apparatus in a transfer-type electrophotographic system having a photosensitive body, wherein the developing apparatus includes a developing roller spaced a small distance from the photosensitive body for supplying a developing solution to the photosensitive body to develop a latent image thereon and to induce a potential on the developing roller through the developing solution from the photosensitive body. A cleaning member is held against the developing roller. In one embodiment, the potential of the developing roller is limited to a level intermediate between predetermined upper and lower limits, an a developing roller is switched into an electrically floating condition except during development of an image. In another embodiment, a developing bias potential is produced responsive to the potential of the developing roller. The bias potential is then applied to the developing roller which is used as a developing electrode.

1 Claim, 10 Drawing Sheets

DEVELOPING APPARATUS

CROSS REFERENCE TO RELATED APPLICATIONS

This application is a continuation of U.S. patent application No. 744,690 filed on June 14, 1985.

BACKGROUND OF THE INVENTION

1. Field of the Invention

The present invention relates to a wet-type developing apparatus for use in a transfer-type electrophotographic machine such as an electrophotographic machine.

2. Discussion of the Background

One method of producing recorded materials free from a smeared background at all times in a transfer-type electrophotographic machine such as an electrophotographic machine is to detect the potential of a latent image on the photosensitive body and apply an appropriate developing bias commensurate with the detected level to a developing electrode. The latent image potential can be detected through the developing solution in a wet-type developing apparatus. However, it is necessary to cover the detecting electrode completely with a latent image in order to detect the latent image potential accurately. Conventional wet-type developing apparata employ a developing electrode plate having an extremely large area. A potential induced via the developing solution from the photosensitive body is applied as a developing bias potential to the developing electrode plate. Since the latent image potential can accurately be detected only when a considerable portion of the latent image on the photosensitive body has entered a developing region, different developing bias potentials are produced before and after the latent image potential is detected, thus resulting in different image densitities. This drawback can be solved by adding another detecting electrode having a smaller area for detecting the latent image potential, and applying a developing bias depedent on the detected potential level to the developing electrode plate. However, such a solution results in an increased cost.

Another problem is that toner is deposited on the detecting electrode and the developing electrode to form dielectric layers on the surfaces of the electrodes, preventing the electrodes from functioning properly. To eliminate this shortcoming, it has been customary to apply a bias to the electrodes in a direction opposite to the developing bias to clean the electrodes electrostatically except during the development of images. This process is nevertheless undesirable in that a large quantity of toner is deposited on the photosensitive body when the electrodes are electrostatically cleaned, thus placing a large burden on a device for cleaning the photosensitive body, and leading to toner deterioration.

SUMMARY OF THE INVENTION

Accordingly, the objects of the present invention are to provide a developing apparatus capable of reducing the burden on a photosensitive body cleaning device and of lowering toner deterioration. between an These and other objects are achieved according, to the present invention, by providing a developing apparatus in a transfer-type electrophotographic system having a photosensitive body, wherein; a latent image on the photosensitive body is developed with a developing solution by a developing roller spaced a small distance from the photosensitive body, and the developing roller is cleaned by a cleaning member. A potential induced on the developing roller through a developing solution from the photosensitive body is employed as a developing bias and is limited by a biasing device to a level intermediate between upper and lower limit potentials. Except during the development of images, the developing roller is brought by a switch into an electrically floating condition. In another embodiment, the developing roller is used as a detecting electrode and a developing electrode, and a developing bias potential is computed by a biasing device from a potential detected by the detecting electrode and is applied to the developing electrode.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
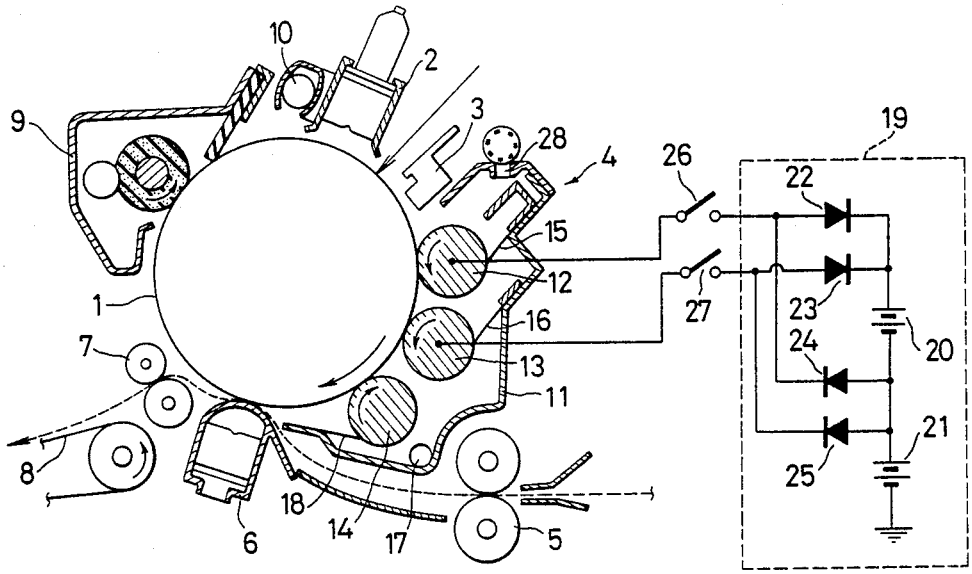
FIG. 1 is a view showing a cross-section and a circuit arrangement of a first embodiment of an electrophotographic copying machine to which the present invention is applied.

Referring now to the drawings, wherein like reference numerals designate identical or corresponding parts throughout the several views, and more particularly to FIG. 1 thereof, during; copying operation, a photosensitive drum 1 is driven by a driving device to rotate in the direction of the arrow at a constant speed. After the photosensitive drum 1 has been uniformly charged by a charger 2, the image of an original to be copied is projected by an exposure device (not shown) onto the photosensitive drum 1 to form a latent image thereon. The charge on the photosensitive drum 1, except where the latent image is formed, is erased by an eraser 3. The latent image on the photosensitive drum 1 is developed by a wet-type developing device 4, and then transferred by a transfer device 6 onto a transfer sheet supplied by rollers 5 from a sheet supply device (not shown) in the direction of the broken-line arrows. The transfer sheet is separated from the photosensitive drum 1 by rollers 7 and fed by a conveyor belt 8 to a fixing device, in which toner is fixed to the transfer sheet. The transfer sheet is then discharged out of the apparatus. After the transfer sheet has been separated, any residual toner is removed from the photosensitive drum 1 by a cleaning device 9, and any residual potential is removed from the photosensitive drum 1 by an eraser 10 to ready the photosensitive drum 1 for a next cycle of copying operation.

The wet-type developing device 4 has developing rollers 12, 13 and a squeeze roller 14 which are disposed in a developing container 11. The developing rollers 12, 13 are spaced a small distance of 0.1 mm from the surface of the photosensitive drum 1. The developing rollers 12 are driven by the driving device to rotate in the direction of the arrows which is opposite to the direction of rotation of the photosensitive drum 1 and at a peripheral speed higher than that of the photosensitive drum 1. Blade-like cleaning members 15, 16 fixed to the developing container 11 are held against the developing rollers 12, 13, respectively, for cleaning off toner from the developing rollers 12, 13 at all times. A developing solution supplied through a developing solution inlet 28 from a developing solution supply means flows down into a space between the developing roller 12 and the cleaning member 15 to form a solution pool therebetween. Rotation of the developing roller 12 causes the developing solution to be uniformly carried onto the surface of the photosensitive drum 1. The developing solution then flows between the photosensitive drum 1 and the developing roller 13. After the developing solution has developed the latent image on the photosensitive drum 1, the developing solution is collected from a developing solution discharge outlet 17 for reuse. The squeeze roller 14 is driven by the driving device to rotate in the direction in which the photosensitive drum 1 rotates, for scraping the excessive developing solution off the photosensitive drum 1. The developing solution on the squeeze roller 14 is in turn scraped off by a scraper 18 in the form of a blade.

The developing device 4 has a sufficient developing ability and an effective developing region which is narrow in the direction of rotation of the photosensitive drum 1. When the developing rollers 12, 13 are brought into an electrically floating condition, they faithfully induce the potential of the latent image on the photosensitive drum 1 and use the induced potential as a developing bias potential to develop the latent image without smearing the background on the transfer sheet. It is found as a result of an experiment that the potential VE induced on the developing rollers 12, 13 can be expressed by the following equation (1), using an actual original to be copied:

$$VE \approx \frac{S1V1 + S2V2}{S1 + S2} \quad (1)$$

where V1 is the potential of an image portion of the latent image, V2 is the potential of a non-image portion of the latent image, S1 is the area of the image portion in the developing region, and S2 is the area of the non-image portion in the developing region.

Figure 2:
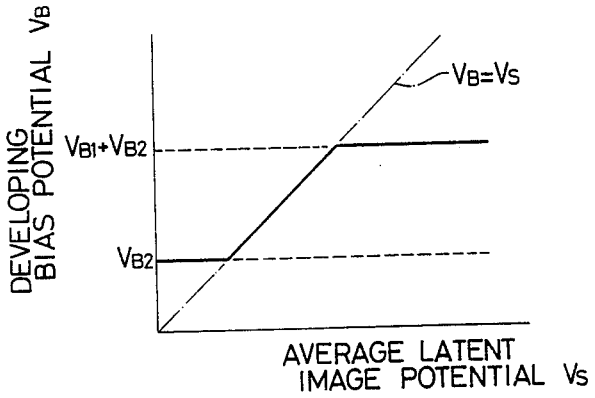
FIG. 2 is a graph showing the relationship between the latent image potential and the developing bias potential in the embodiments shown in FIG. 1.

If the developing rollers 12, 13 are kept in the electrically floating condition, then the potentials VE, V2 are substantially equal to each other for an original in which the image portion has an extremely small area, resulting in a copy with a smeared background due to exposure irregularities and charging irregularities. If an original in which the image portion has an extremely large area, then the potentials VE, V1 are substantially the same in level and a potential contrast required for development cannot be obtained, with the consequence that the produced copy has an extremely low image density. To eliminate the above difficulties and to copy an original such as a colored original in which the potential of a non-image portion is higher than an ordinary original having a white background, a biasing device 19 is employed for producing a copy free from a smeared background and having a high image density. The biasing device 19 is composed of DC power supplies 20, 21 and diodes 22 through 25 for applying two potentials to the developing rollers 12, 13 through switches 26, 27. More specifically, when the potential VE of the developing rollers 12, 13 is lower than a lower limit potential VB2 of the DC power supply 21 during development, the diodes 22, 23 are rendered nonconductive and the diodes 24, 25 are rendered conductive to allow the DC power supply 21 to apply the lower limit potential VB2 to the developing rollers 12, 13. When the potential VE of the developing rollers 12, 13 is intermediate between the lower limit potential VB2 and an upper limit potential (VB1 + VB2) which is the sum of the voltages VB1, VB2 of the DC power supplies 20, 21, then the diodes 22 through 25 are rendered nonconductive and the voltages of the developing rollers 12, 13 remain the same as the induced voltages. When the potential VE of the developing rollers 12, 13 is higher than the upper limit voltage, the diodes 22, 23 are rendered conductive and the diodes 24, 25 are rendered nonconductive to apply the upper limit voltage to the developing rollers 12, 13, the voltages of which are now limited to the upper limit voltage. The aforesaid manner in which different voltages are applied is illustrated in FIG. 2. The upper and lower limit voltages are appropriately determined dependent on the photosensitive drum 1 employed, and may be variable by an exposure adjusting device (not shown) for better advantages.

The switches 26, 27 are closed by a sequence controller of this copying machine only during the development process, and closed by the sequence controller except during the development process. The potential difference between the developing rollers 12, 13 and the photosensitive drum 1 is therefore minimized to suppress electrostatic deposition of toner on the photosensitive drum 1 for thereby reducing toner deterioration and preventing the cleaning device 9 from being subject to an increased load or burden.

While two developing rollers are shown in the above embodiment, the number of developing rollers used may be suitably determined dependent on the copying speed. The developing rollers are shown to be in respective independent circuit arrangements. However, they may be in a common circuit arrangement for attaining substantially the same advantages. The squeeze roller 14 may electrically connected to the developing roller 13. The present invention may be incorporated in a wet-type developing apparatus for use in a transfer-type electrophotographic system such as a printer.

Figure 3:
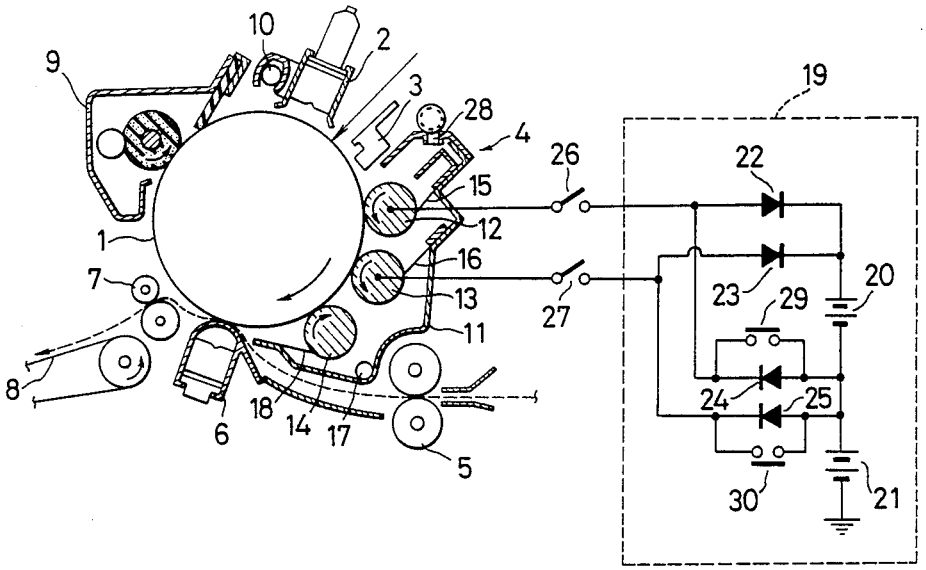
FIG. 3 is a view showing a cross-section and a circuit arrangement of a second embodiment of an electrophotographic copying machine to which the present invention is applied.
Figure 4:
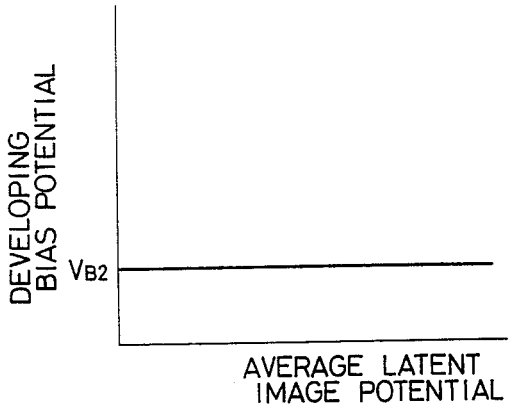
FIG. 4 is a diagram illustrating a fixed bias condition of the embodiment of FIG. 3.

FIG. 3 shows a second embodiment of an electrophotographic copying machine to which the present invention is applied. When the developing rollers 12, 13 are in the electrically floating condition and if a plurality of densities or color information is present in the same original in the transverse direction thereof, some information may not be developed and may be lost since the potentials of the developing rollers 12, 13 faithfully vary with respect to the latent image potential. To eliminate this drawback, switches 29, 30 are connected parallel to the diodes 24, 25, respectively, in the circuit of the preceding embodiment. The switches 29, 30 are normally open and can be closed when the operator operates upon switches (not shown) on the control panel. As long as the switches 29, 20 are open, the developing apparatus operates in the same way as the preceding embodiment to produce a copy free from a smeared background and having a high image density. When, the switches 29, 30 are closed, the diodes 24, 25 are short-circuited to cause the DC power supply 21 to apply the constant developing bias voltage VB2 to the developing rollers 12, 13 as shown in FIG. 4. Therefore, where there are a number of densities present in the same original in the transverse direction thereof, the switches on the control panel are operated upon to close the switches 29, 30 to keep the developing bias voltage constant for thereby developing a latent image potential difference faithfully. Therefore, a copy having good gradations can be produced.

Figure 5:
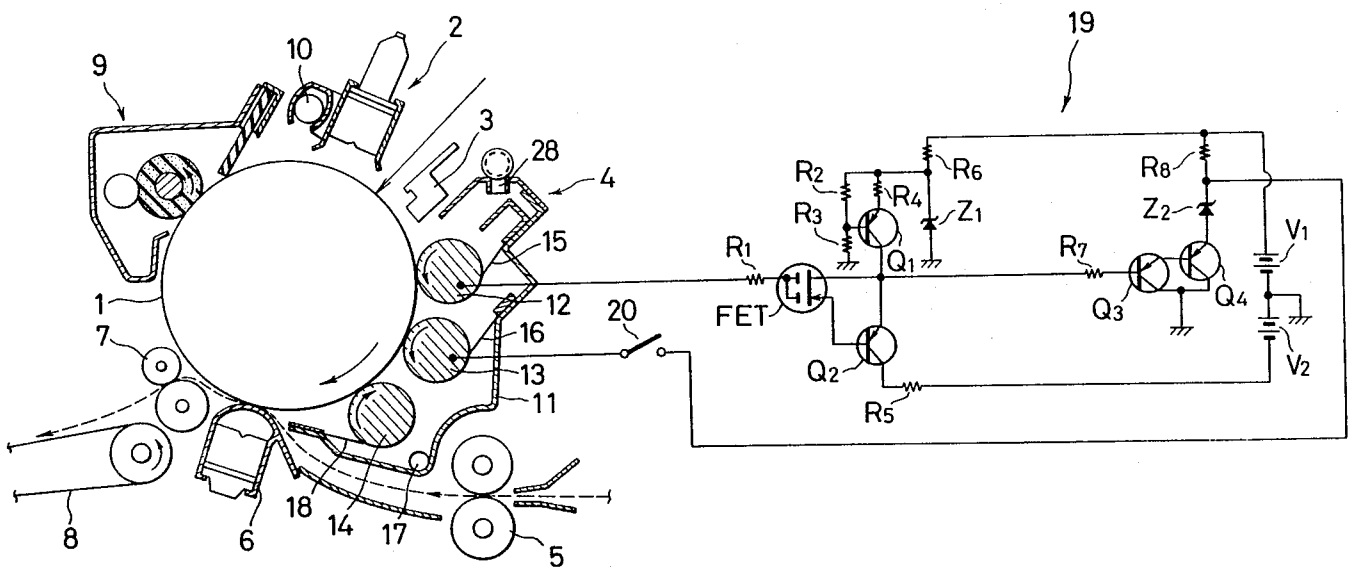
FIGS. 5–12 are views showing cross-sections and circuit arrangements of respective additional embodiments of the invention.

With the arrangement of the present invention as above described with respect to FIGS. 1–4; since the induced potentials of the developing rollers are limited by the biasing device to a level intermediate between the upper and lower limit potentials, images can be developed to produce copies free from smeared backgrounds and high image densities. Except during development, the developing rollers are switched into the electrically floating condition, and the developing rollers are cleaned by the cleaning members, rather than by an electrostatic cleaning means. Therefore, toner deterioration can be lowered, and the load or burden on the photosensitive body cleaning device can be reduced. The developing apparatus is inexpensive as it is not required to provide detecting electrodes other than the developing rollers. In a third embodiment shown in FIG. 5, the developing device 4 again has a sufficient developing ability and an effective developing region which is narrow in the direction of rotation of the photosensitive drum 1. The developing roller 12 serves also as a detecting electrode for detecting about 90% of the potential of the latent image on the photosensitive drum 1 through the developing solution. A biasing device 19 is composed of a fieldeffect transistor FET, transistors Q1 through Q4, zener diodes Z1, Z2, resistors R1 through R8, and DC power supplies V1, V2. An input potential applied from the developing roller 12 is impedance-converted by the field-effect transistor FET. A constant voltage is then added to the input potential by the zener diode Z1 through an amplifier composed of the transistors Q3, Q4 and having an amplification degree of 1, thus producing a developing bias voltage which is substantially equal to the average latent image potential on the photosensitive drum 1. The developing bias potential is applied via a switch 20 to the developing roller 13 doubling as a developing electrode for developing the image free from a smeared background. The switch 20 is controlled by a controller of the developing apparatus so as to be closed only during the development process in which the developing rollers 12, 13 confront the latent image on the photosensitive drum 1, and so as to remain open except during the development process. Therefore, a potential difference between the developing rollers 12, 13 and the photosensitive drum 1 is minimized to suppress electrostatic deposition of toner on the photosensitive drum 1.

Figure 6:
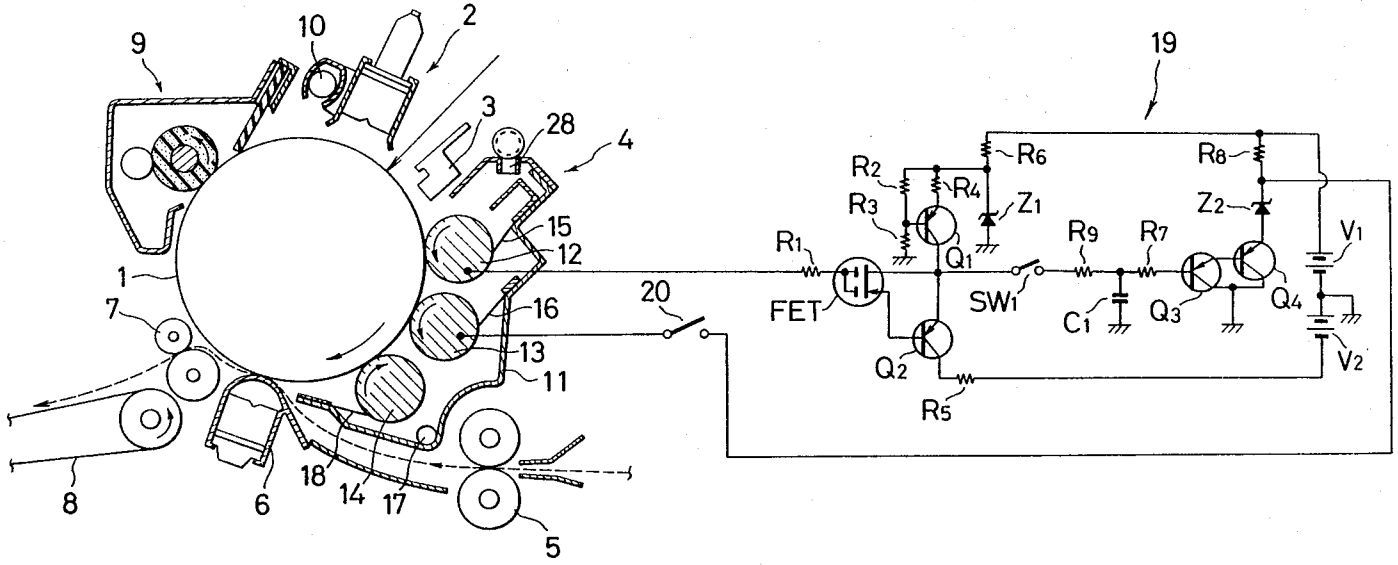

FIG. 6 shows a fourth embodiment of the electrophotographic copying machine to which the present invention is applied. In this embodiment, a memory circuit including a resistor R9 and a capacitor C1 and a switch SW1 are added to the preceding embodiment. The switch SW1 is controlled by the sequence controller of the developing apparatus so as to be closed only when the leading end of the latent image on the photosensitive drum 1 confronts the developing roller 12, thus storing the output signal from the field-effect transistor FET in the capacitor C1. To the potential stored in the capacitor C1, there is added a constant potential by the zener diode Z2 by the transistors Q3, Q4 to produce a developing bias potential. Since the leading end of the latent image (the leading end of the original) is generally blank, the developing bias potential can be determined without depending on the image. The switch SW1 should be closed during the period of time in which the length up to 50 mm from the leading end of the latent image or, preferably the length of 5 mm ±2 mm from the leading end of the latent image (in the direction of rotation of the photosensitive drum 1) confronts the developing roller 12.

Figure 7:
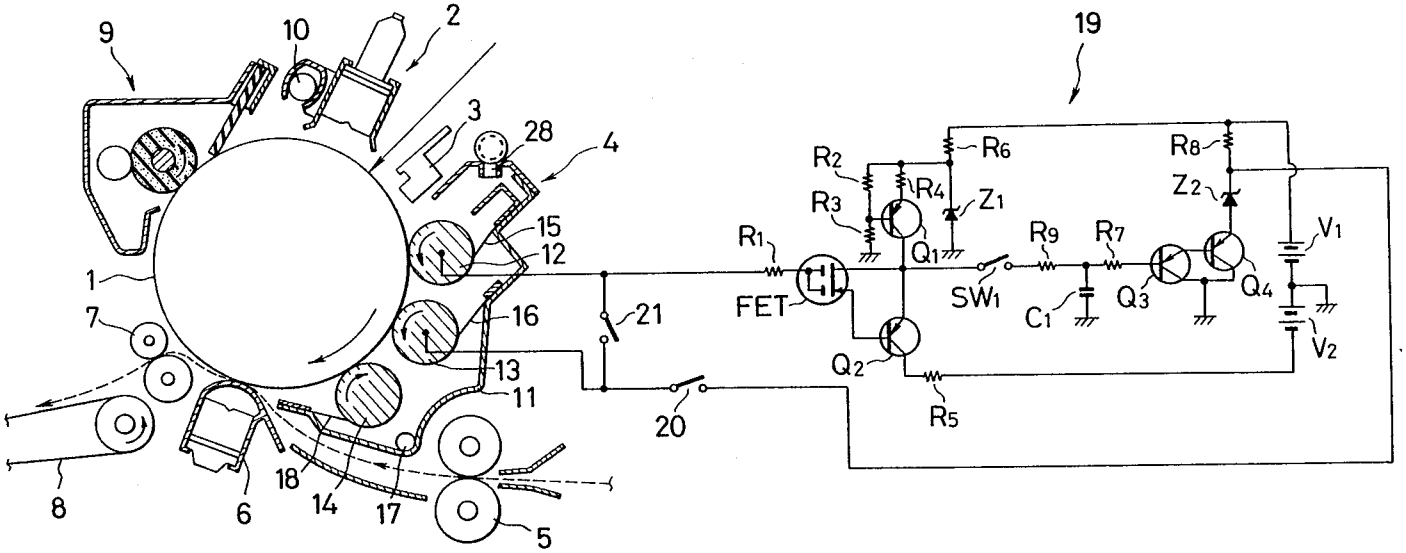

FIG. 7 shows a fifth embodiment of the electrophotographic copying machine to which the present invention is applied. In this embodiment, the developing roller 12 is employed also as a developing electrode, and a switch 21 is added in the fourth embodiment. The switch 21 is closed by the sequence controller immediately after the switch SW1 has been opened, and is opened after the latent image has been developed. The developing bias potential from the biasing device 19 is applied through the switch 20 to the developing rollers 12, 13.

Figure 8:
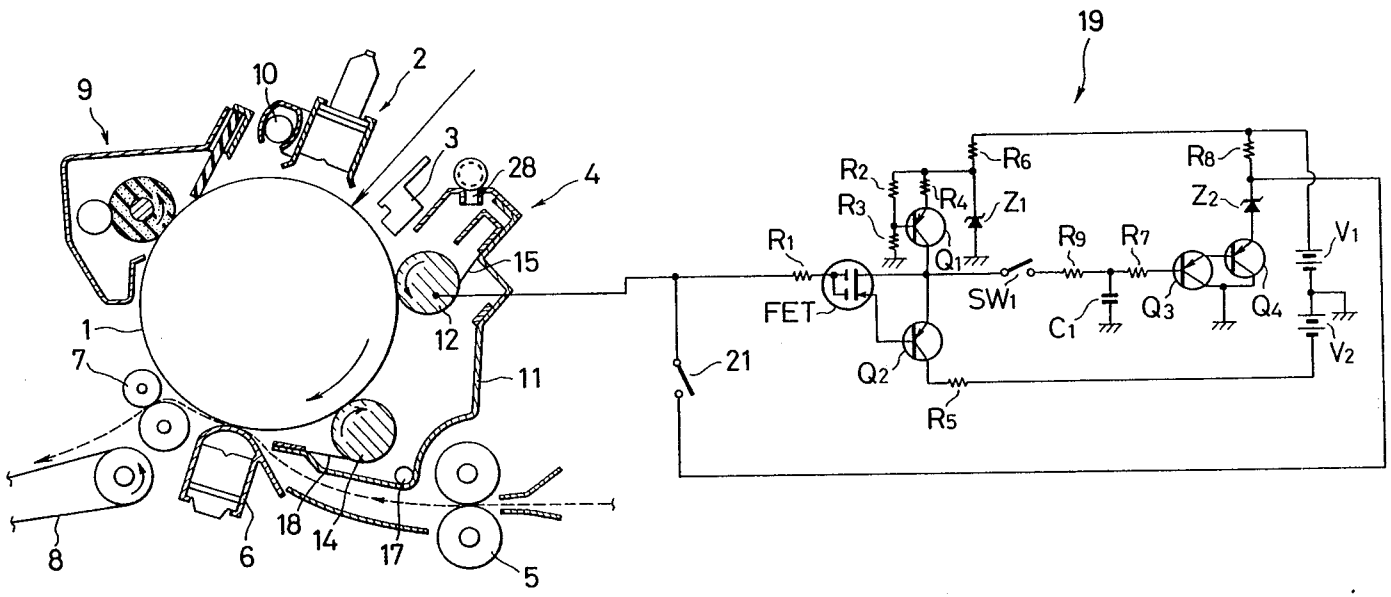

FIG. 8 illustrates a sixth embodiment of the electrophotographic copying machine to which the present invention is applied. In the sixth embodiment, the developing roller 13, the cleaning member 16, and the switch 20 in the fifth embodiment are dispensed with. The developing bias potential from the biasing device 19 is applied through the switch 21 to the developing roller 12.

Figure 9:
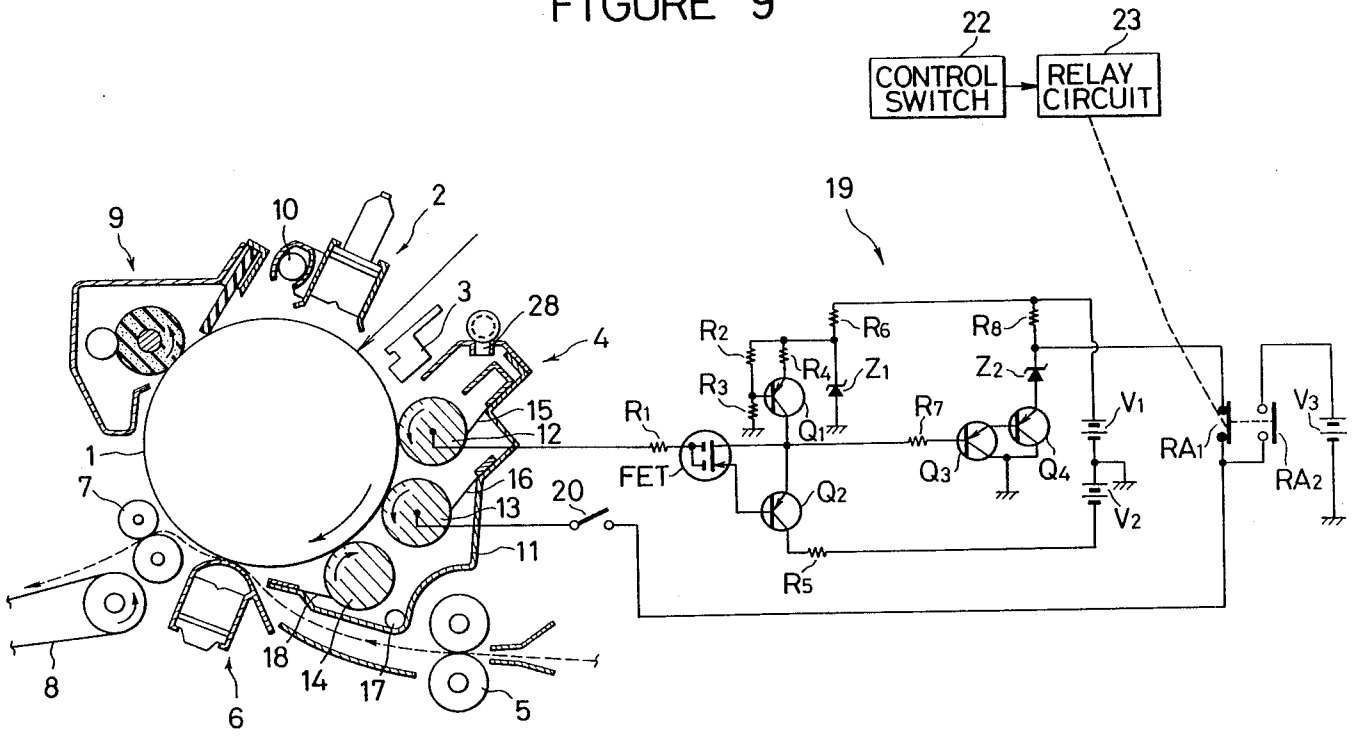
Figure 10:
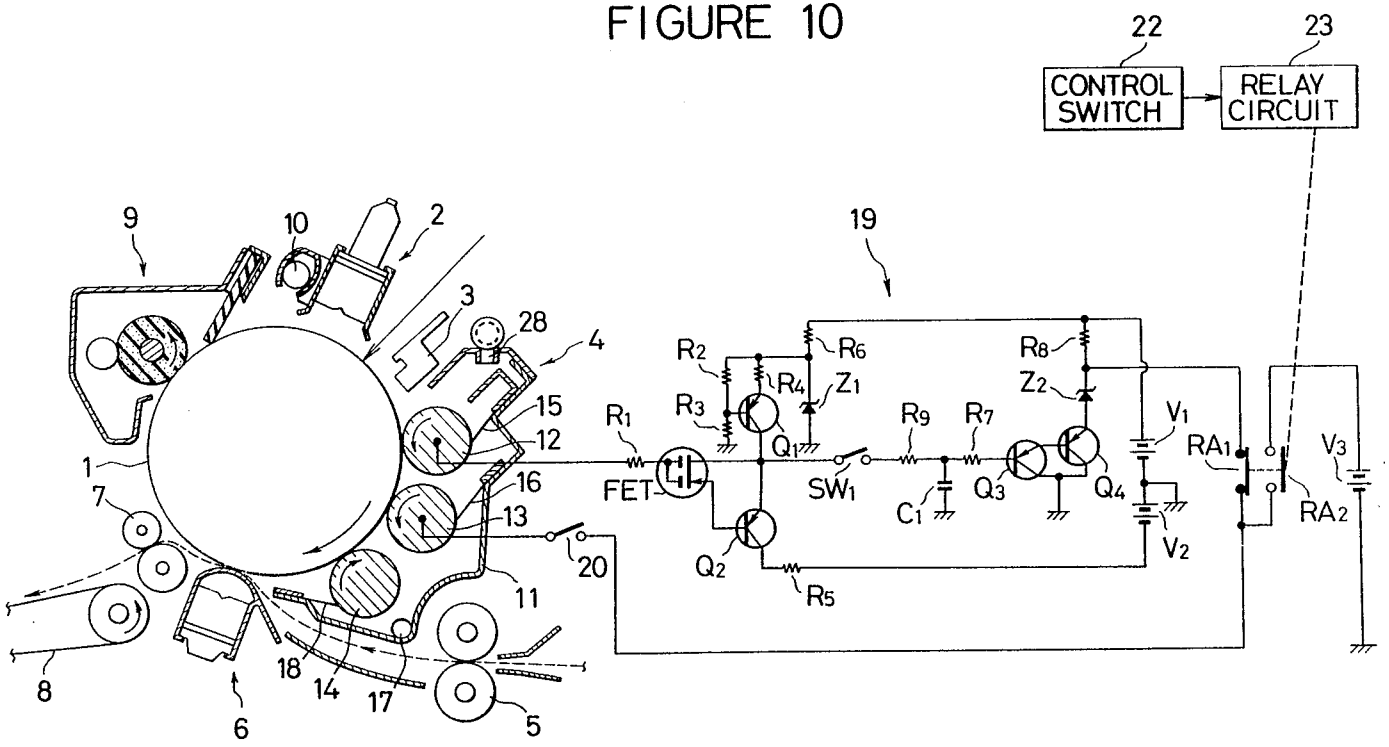
Figure 11:
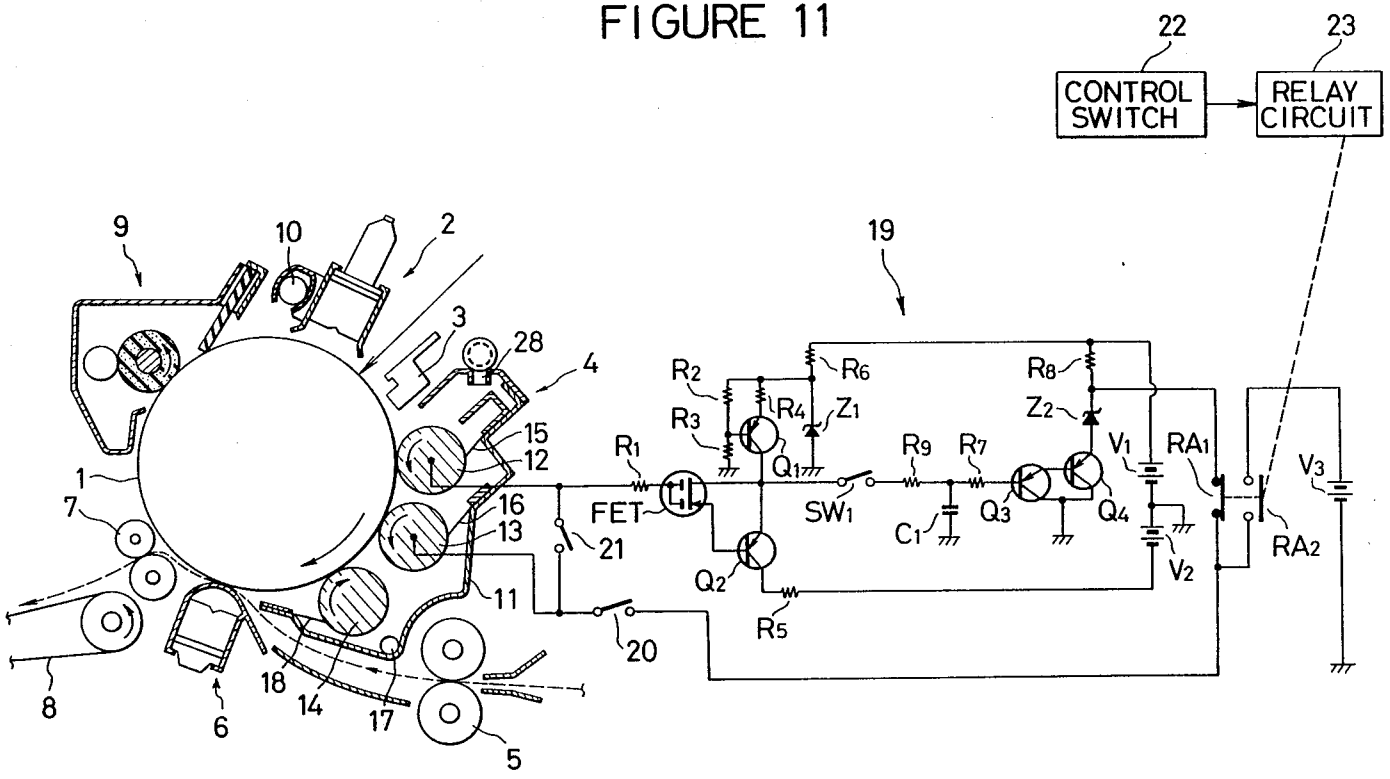
Figure 12:
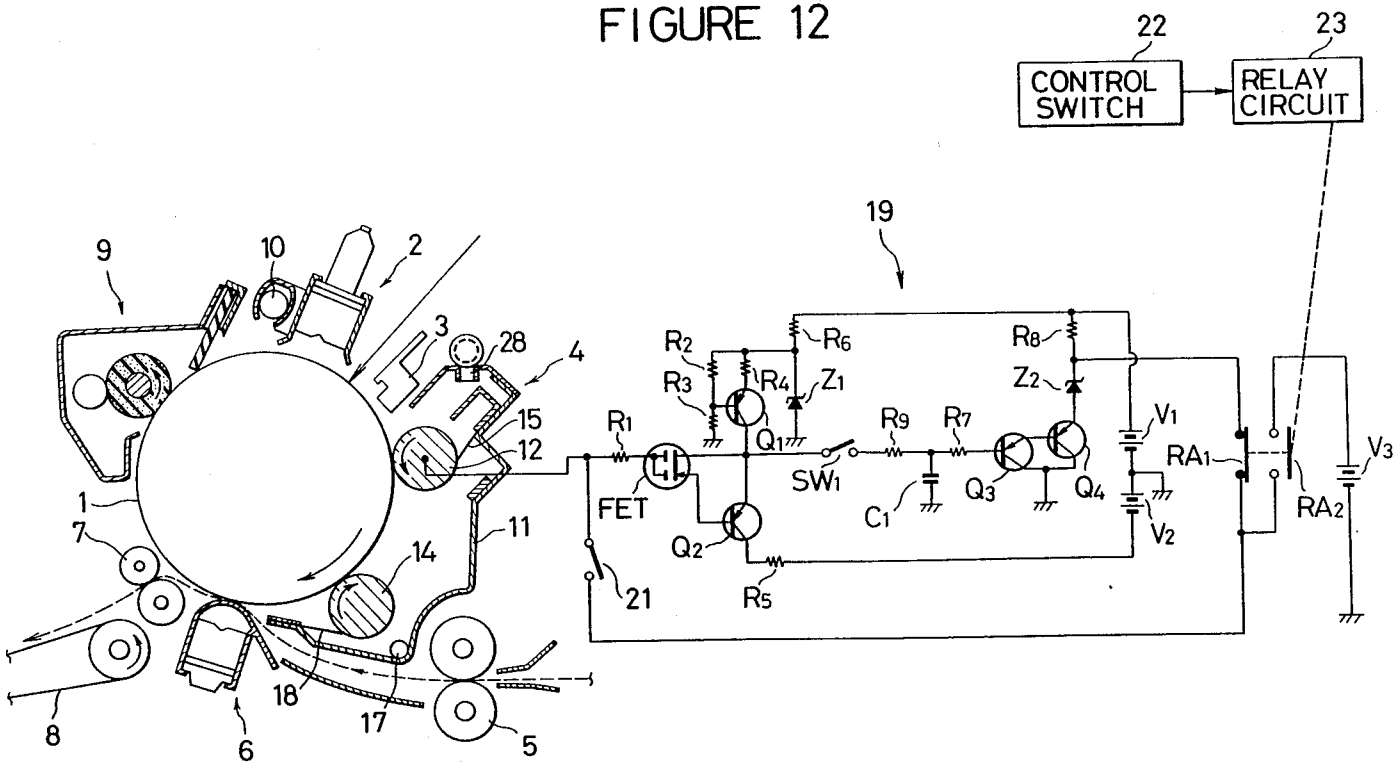

FIGS. 9 and 12 illustrate modifications in which an automatic bias mode and a fixed bias mode can be selected in the third through sixth embodiments. Normally, the normally-closed contact RA1 of a relay is closed and the normally-open contact RA2 thereof is open to select the automatic bias mode in which the developing bias mode is applied by the biasing device 19 to the developing roller. When the operator operates upon a control switch 22 on the control panel, a relay circuit 23 is actuated to open the normallyclosed contact RA1 and close the normally-open contact RA2. The fixed bias mode is now selected to apply a contact potential from a DC power supply V3, instead of the developing bias potential from the biasing device 19, to the developing roller. As a result, the developing bias potential is kept at a constant level for developing a potential difference of the latent image with fidelity, thereby producing a copy having good gradations. The relay circuit 23 is inactivated upon completion of repeated copying cycles.

As with the first and second embodiments above described, in the remaining embodiments described three or more developing rollers may be employed dependent on the copying speed, and the squeeze roller 14 may be electrically connected to the developing roller 12 or 13. The present invention may also be applied to a developing apparatus in a transfer-type electrophotographic system such as a printer.

With the arrangement of the present invention, as described in relation to FIGS. 5–12, the developing apparatus is inexpensive since the developing roller is employed as a detecting electrode. The developing rollers used as the electrodes are cleaned by an electrostatic cleaning means, rather than by the cleaning members. Therefore, toner deterioration can be lowered, and the load or burden on the photosensitive body cleaning device can be reduced.

Obviously, numerous additional modifications and variations of the present invention are possible in light of the above teachings. It is therefore to be understood that within the scope of the appended claims, the invention may be practiced otherwise than as specifically described.

What is claimed as new and desired to be secured by letters patent of the United States is:

1. In a transfer-type electrophotographic system having a photosensitive body, a developing apparatus comprising:

at least two developing rollers spaced apart and rotatably driven for supplying a developing solution to the photosensitive body to develop a latent image thereon, wherein the first one of said developing rollers, which is at a small distance from said photosensitive body, serves as a detecting electrode for detecting the potential of the latent image on said photosensitive body through the developing solution and also as a developing electrode and further wherein said first roller is subjected to a substantially electrically-floating condition and wherein a second of said developing rollers placed, at a small distance from said photosensitive body is used for developing the latent image;

a cleaning member held against said second developing roller; and a biasing device responsive to the potential of said first developing roller as said detecting electrode for computing a developing bias potential and applying the developing bias potential to said first developing roller as a developing electrode.

* * * * *